US010603597B1

(12) United States Patent
Pruzansky et al.

(10) Patent No.: US 10,603,597 B1
(45) Date of Patent: Mar. 31, 2020

(54) ARTICLE EJECTION STRUCTURE

(71) Applicant: SPIN MASTER LTD., Toronto (CA)

(72) Inventors: Amy A. Pruzansky, Toronto (CA); David L. McDonald, Mississauga (CA); Tat Wah Wong, Hong Kong (CN)

(73) Assignee: SPIN MASTER LTD., Toronto, Ontario (CA)

( * ) Notice: Subject to any disclaimer, the term of this patent is extended or adjusted under 35 U.S.C. 154(b) by 0 days.

(21) Appl. No.: 16/219,914

(22) Filed: Dec. 13, 2018

(51) Int. Cl.
*A63H 11/06* (2006.01)
*A63H 13/16* (2006.01)
*A63H 3/00* (2006.01)

(52) U.S. Cl.
CPC ..... *A63H 13/16* (2013.01); *A63H 3/008* (2013.01)

(58) Field of Classification Search
CPC ..... A63H 3/00; A63H 13/16; A63H 17/02; A63H 29/04; A63H 3/20; A63H 3/40; A63H 3/008
USPC ..... 446/69, 71–75, 153, 175, 295, 308–312, 446/486–489
See application file for complete search history.

(56) References Cited

U.S. PATENT DOCUMENTS 685,345 A * 10/1901 Perkins
1,585,887 A * 5/1926 Beach ..... A63H 13/16 446/310
2,858,644 A * 11/1958 Derham ..... A63H 13/16 215/316
4,414,774 A 11/1983 Fogarty et al.
5,299,968 A 4/1994 Bennett
6,468,126 B1 * 10/2002 Herber ..... A63H 13/16 446/308
6,592,426 B2 * 7/2003 Mesch ..... A63H 13/16 446/175
6,702,644 B1 * 3/2004 Hornsby ..... A63H 3/008 446/175
7,861,444 B2 1/2011 Marlow
7,862,397 B1 * 1/2011 Ng ..... A63H 29/16 40/411
9,550,128 B1 * 1/2017 Pruzansky ..... A63H 3/006
10,238,981 B2 * 3/2019 McDonald ..... A63H 29/22
2006/0030236 A1 * 2/2006 Ueno ..... A63H 13/16 446/310

* cited by examiner

*Primary Examiner* — Nini F Legesse
(74) *Attorney, Agent, or Firm* — Millman IP Inc.

(57) ABSTRACT

An article ejection structure is disclosed, having a housing, and a first biasing member positioned in the housing and having a first biasing force biasing the first biasing member toward a first neutral position to drive a rupture structure to rupture the housing. A release member restricts the first biasing member from moving toward the first neutral position when the release member is in a lock state, and is conditionable to a release state, in which the release member at least partially releases the first biasing member to move toward the first neutral position and drive the ejection structure to rupture the housing. A second biasing member positioned in the housing, the second biasing member having a second biasing force biasing the second biasing member toward a second neutral position to drive an article positioned in the housing out of the housing when the housing is ruptured.

25 Claims, 9 Drawing Sheets

ARTICLE EJECTION STRUCTURE

FIELD

The specification relates generally to housed articles and, in particular, to an article ejection structure.

SUMMARY OF THE DISCLOSURE

In one aspect, there is provided an article ejection structure, comprising: a housing; a first biasing member positioned in the housing, the first biasing member having a first biasing force biasing the first biasing member toward a first neutral position to drive a rupture structure to rupture the housing; a release member restricting the first biasing member from moving toward the first neutral position when the release member is in a lock state, the release member being conditionable to a release state, in which the release member at least partially releases the first biasing member to move toward the first neutral position and drive the ejection structure to rupture the housing; an article positioned in the housing; and a second biasing member positioned in the housing, the second biasing member having a second biasing force biasing the second biasing member toward a second neutral position to drive the article at least partially out of the housing when the housing is ruptured.

The first biasing member can be coupled to the second biasing member to move the second biasing member when the first biasing member moves toward the first neutral position. The rupture structure can include the article.

The first biasing force can be greater than the second biasing force.

The second biasing force can be insufficient to drive the article to rupture the housing.

The first biasing member can have a first spring rate, and the second biasing member can have a second spring rate, the second spring rate being lesser than the first spring rate.

The article ejection structure can further include a restoration alignment structure limiting driving of the rupture structure by the first biasing member along an axis. The restoration alignment structure can include a limiter slidingly moveable in the housing along the axis, the limiter being held in a restricting position relative to the housing via the release member when the release member is in the lock state, in which the limiter restricts movement of the first biasing member toward the first neutral position. The limiter can include a slot through which the release member extends, the slot being accessible from an exterior of the housing, the housing including an abutment surface positioned adjacent the slot when the limiter is in the restricting position. The release member can be at least partially made of a natural fiber, such as a paper product.

The rupture structure can include the limiter.

The article ejection structure can further comprise a restoration alignment structure limiting driving of the article at least partially out of the housing by the second biasing member along an axis.

The restoration alignment structure can be a first restoration alignment structure, and the axis can be a first axis, and the article ejection structure can further include a second restoration alignment structure limiting expansion of the second biasing member along a second axis.

The first axis can be parallel to the second axis.

The second restoration alignment structure can include a post extending along the second axis from the limiter, and the second biasing member can have a through-hole that receives the post. The article can have an aperture for receiving the post.

The housing can be provided with a weakened region having a lower tensile strength and the article can be positioned adjacent to the weakened region in the housing.

The weakened region can include at least one score line.

The first biasing member can be a coil spring.

In another aspect, there is provided an article ejection structure, comprising: a housing; a biasing member positioned in the housing; a rupture structure positioned within the housing; and a release member made at least partially of natural fiber and restricting restoration of the biasing member when the release member is in a lock state, the release member being conditionable to a release state via application of a fluid thereto, in which the release member at least partially releases the biasing member to move toward a neutral position and drive the rupture structure to rupture the housing.

The article ejection structure can further include a limiter retained in a restricting position relative to the housing via the release member to restrict restoration of the first biasing member.

The limiter can include a slot through which the release member extends, the slot being accessible from an exterior of the housing, and the housing can include an abutment surface positioned adjacent the slot when the limiter is in the restricting position.

The release member can be at least partially made of a paper product.

The fluid can include water.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
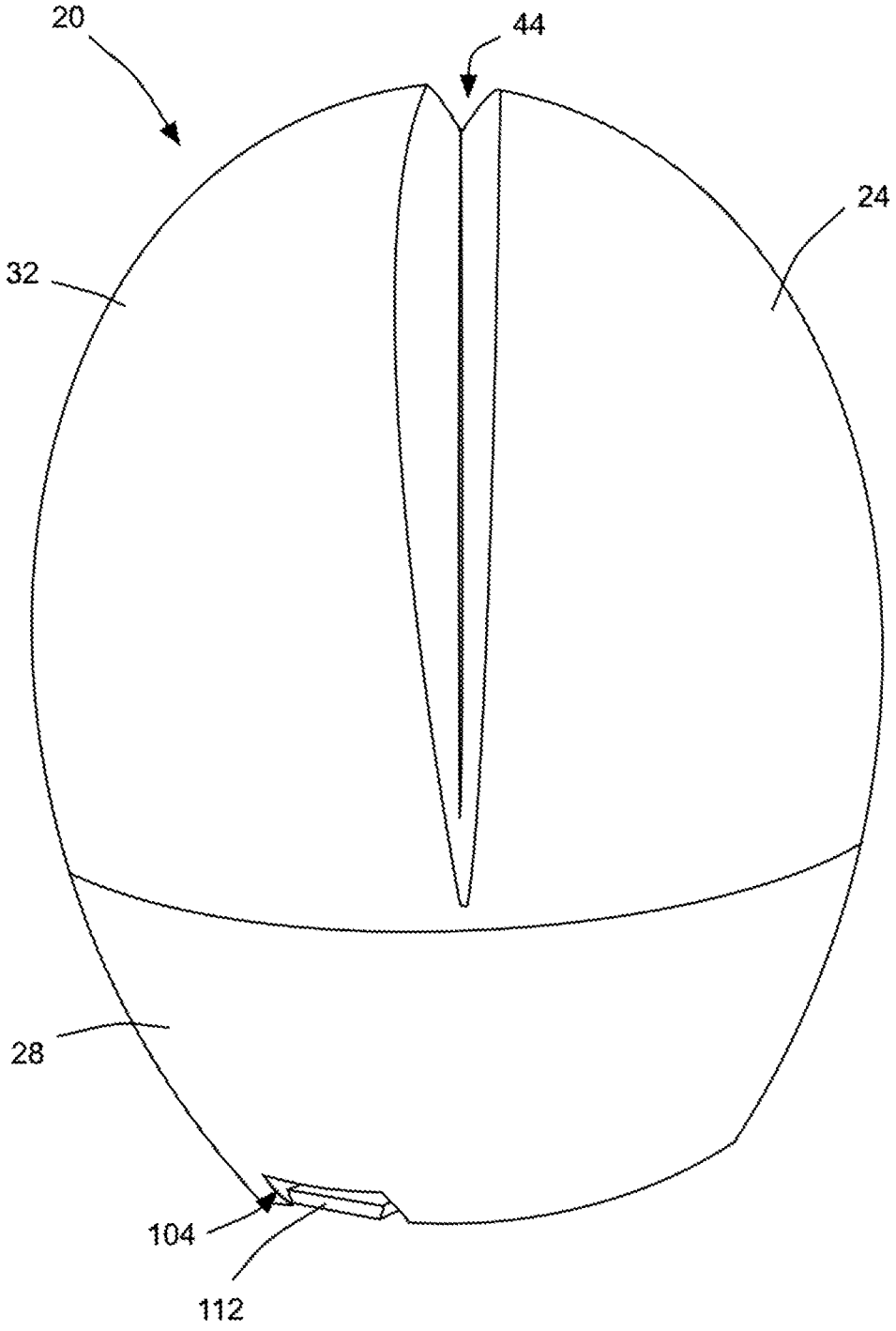
FIG. 1 shows a package employing an article ejection structure in accordance with one embodiment thereof.
Figure 2:
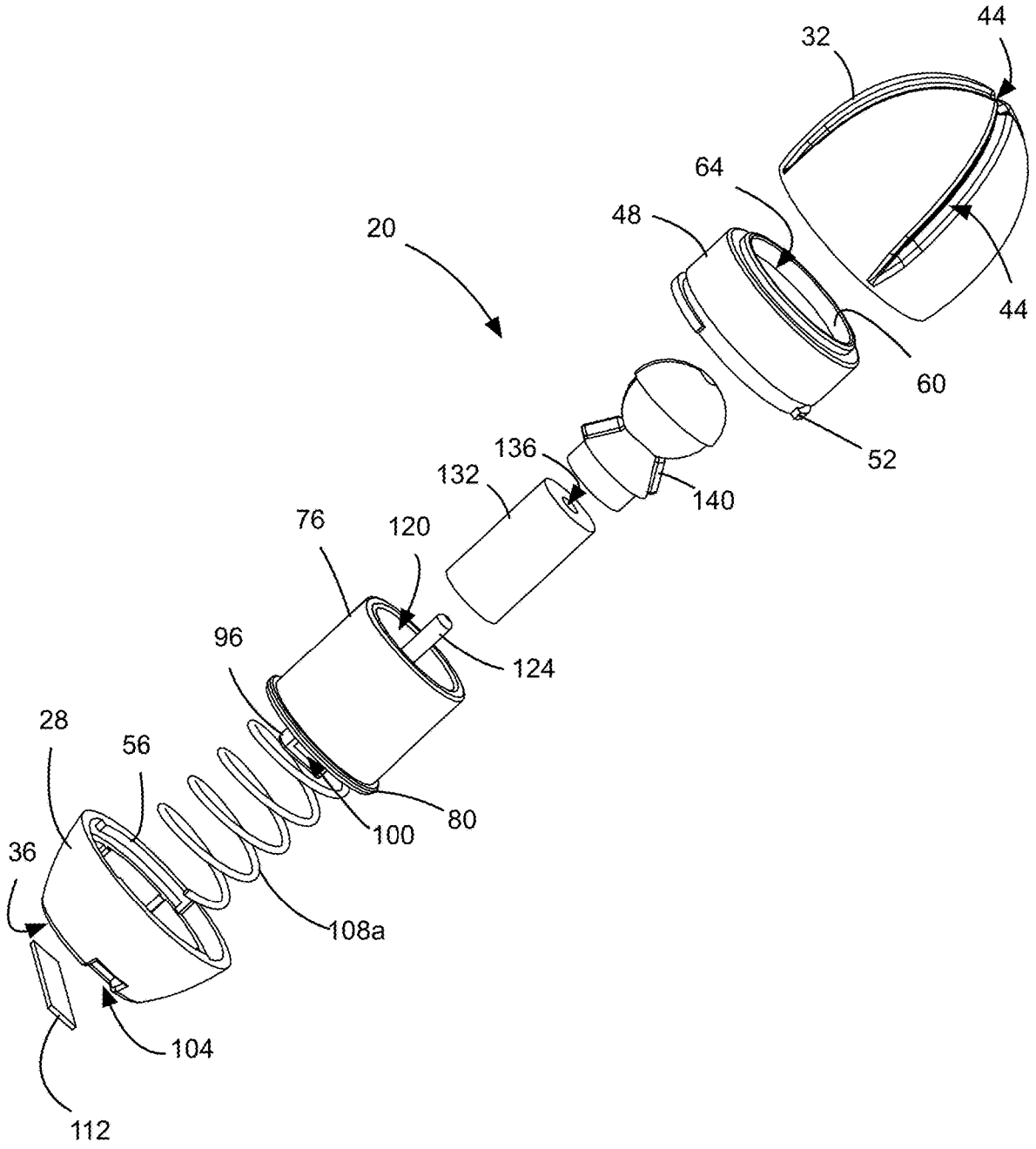
FIG. 2 is an exploded view of the package of FIG. 1.
Figure 3:
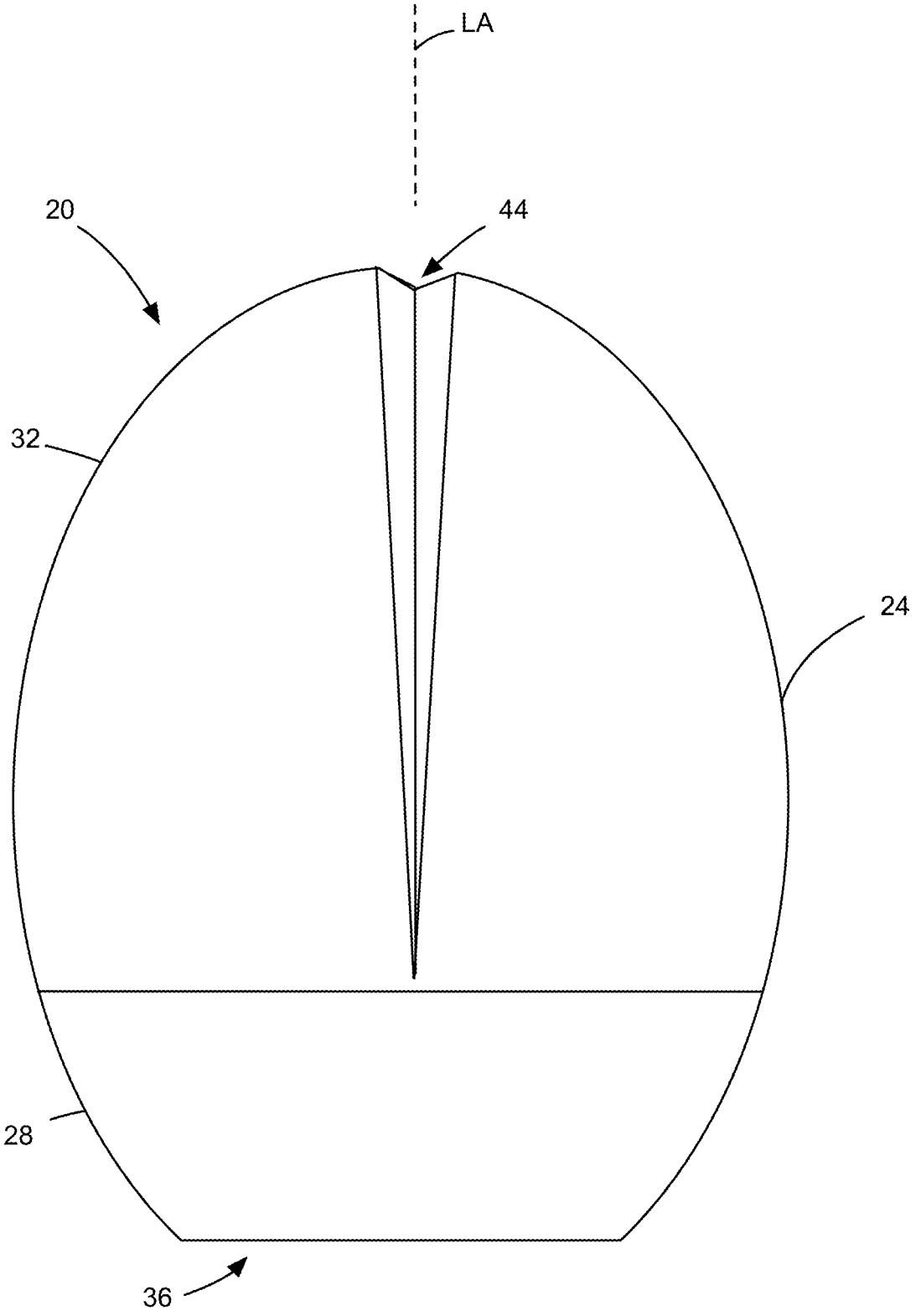
FIG. 3 is a front elevation section view of the package of FIG. 1.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

A package 20 employing an article ejection structure in accordance with an embodiment is shown in FIGS. 1 to 4A. The package 20 in this embodiment is a toy "egg" that houses an article in the form of a figurine that, when the egg is exposed to certain fluids, such as water or ambient air with water vapor, releases a mechanism housed in the egg to rupture the egg and eject the figurine from the egg. The figurine is ejected from the egg at a relatively slow speed to simulate a living creature making their way into the world.

The package 20 has a housing 24 constructed from a lower housing portion 28 and an upper housing portion 32. The lower housing portion 28 and the upper housing portion 32 are made of a plastic or other suitable material, so as to be safe for handling by children. The lower housing portion 28 and the upper housing portion 32 are secured together in any suitable manner, such as corresponding threaded surfaces, through the use of an adhesive, thermal bonding, etc. While in the embodiment shown, the housing 24 is in the form of an egg shell, the housing 24 may have any other suitable shape. The lower housing portion 28 and the upper housing portion 32 can be made, for example, by fusing or otherwise securing together injection-molded parts. In other embodiments, the housing can be formed from one or more members of any configuration, such as two lateral halves which are fixedly joined together so as to substantially provide an enclosure. Alternatively, the housing may only provide a partial enclosure.

The lower housing portion 28 has a generally flat bottom surface 36 enabling the package 20 to maintain an upright stance when placed on a flat surface. When mated together, the lower housing portion 28 and the upper housing portion 32 form a shell defining an inner space 40. While, in the described embodiment, the housing 24 (at least the upper housing portion 32, in particular) is generally continuous, in other embodiments, the housing may have one or more apertures.

The upper housing portion 32 is generally uniform in thickness, but has one or more weakened regions. The weakened regions in this embodiment have a lower tensile strength than other regions of the upper housing portion 32. In particular, the weakened regions in this embodiment are scores 44 that are areas (grooves, in this case) of reduced thickness of the housing 24. In other embodiments, the weakened regions can be provided via perforations, material changes, thermal or chemical transformations, etc. Additionally or alternatively, the weakened regions can be formed of a harder material that is more brittle than in other areas of the housing 24.

A tubular guide 48 is secured in the housing 24 via peripheral threading 52 about its lower periphery being received within corresponding interior circumferential threading 56 about an upper interior circumference of the lower housing portion 28. The tubular guide 48 has an inner guide surface 60 that defines a tubular channel 64 extending along a longitudinal axis LA of the package 20. The inner guide surface 60 has a step 68 partway along the longitudinal axis defining an upper channel portion 72 at a lower end of the tubular channel 64 and an enlarged lower channel portion 76. In other embodiments, the inner guide surface 60 can be also or alternatively extend in the upper housing portion 32, or can be integrally formed with the housing 24.

Slidingly received within the tubular channel 64 of the tubular guide 48 is a limiter 80. The limiter 80 has an outer longitudinally extending surface 84 having a profile along most of its longitudinal length that generally matches the profile of the upper channel portion 72. Movement of the limiter 80 is thus limited by the tubular guide 48 to a longitudinal direction parallel to the longitudinal axis LA. While the outer longitudinally extending surface 84 of the limiter 80 and the upper channel portion 72 of the inner guide surface 60 are generally continuous and are similarly profiled (that is, they have a similar cross-section), in other embodiments, the limiter 80 and the inner guide surface 60 can have other forms that cooperate to enable the limiter 80 to be slidingly movable relative to the inner guide surface 60.

Figure 4A:
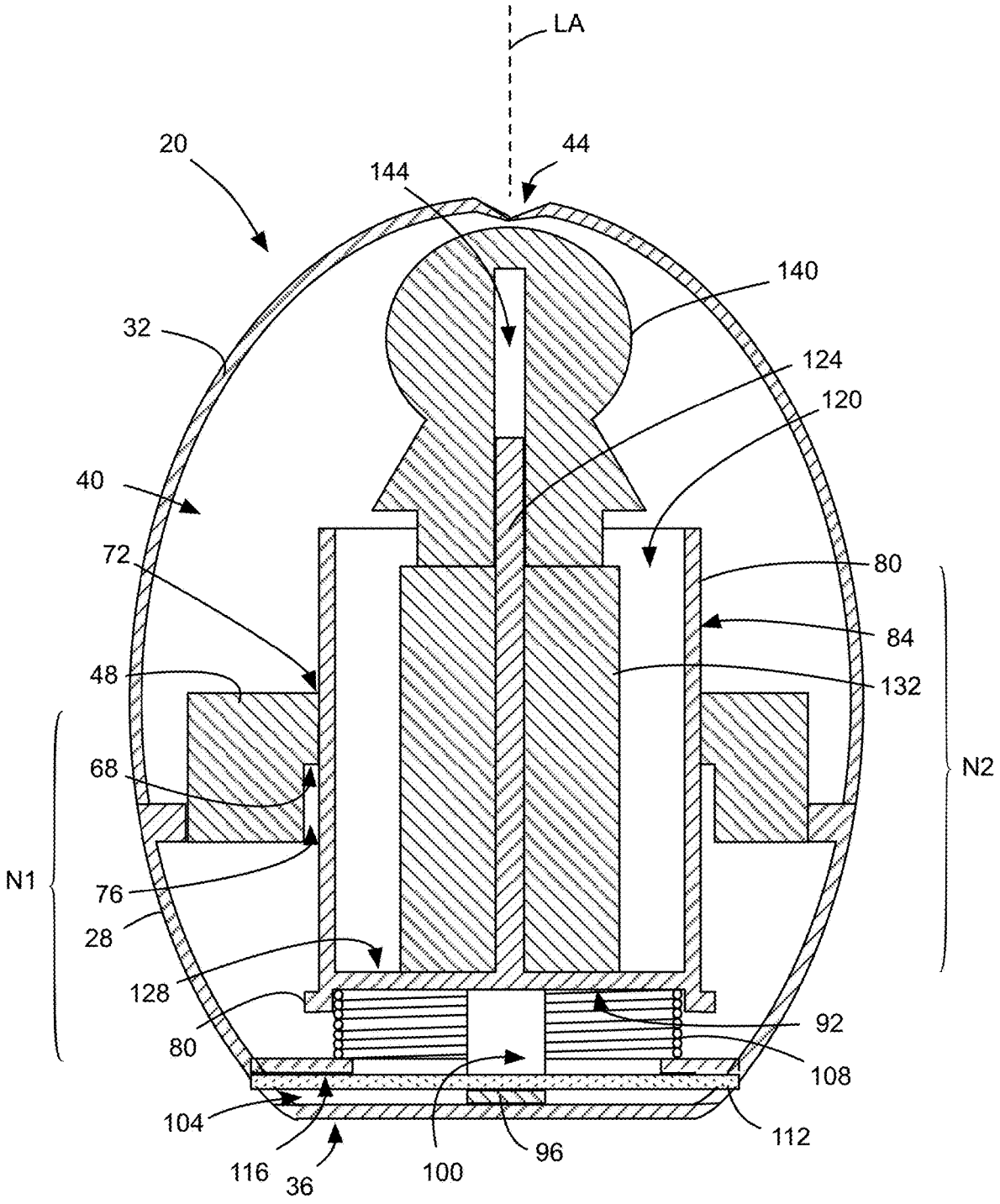
FIG. 4A is a schematic front elevation section view of the package of FIG. 1 with a release member in a lock state.

A lower ridge 88 extends radially from (relative to the longitudinal axis LA) and circumferentially about a lower end of the limiter 80. The lower ridge 88 is dimensioned to be slidingly received within the lower channel portion 76 of the tubular guide 48, but be restricted from continued longitudinal travel through the tubular guide 48 by abutment with the step 68. An upwardly recessed bottom surface 92 of the limiter 80 has a slotted box 96 extending downwardly therefrom. The slotted box 96 has a box slot 100 extending laterally therethrough. When the limiter 80 is in a lower restricting position, as shown in FIG. 4A, the slotted box 96 is positioned adjacent the lower housing portion 28. In the lower restricting position, the box slot 100 is aligned with a release member slot 104 in the housing 24. The release member slot 104 is an aperture that extends into the housing 24 and at least into the box slot 100 of the slotted box 96. In this embodiment, the release member slot 104 extends fully from one lateral side of the housing 24, through the box slot 100, and to another lateral side.

A biasing member in the form of a coil spring 108 is positioned between the bottom surface 92 of the limiter 80 and the lower housing portion 28. The coil spring 108 is a resilient structure made of metal, but can be made of any suitably resilient material. A biasing force of the coil spring 108 acts to bias the coil spring 108 toward a neutral position N1. The neutral position N1 of the coil spring 108 refers to the form of the coil spring 108 in which, when unimpeded, the coil spring 108 neither expands nor contracts. The coil spring 108 is secured to the lower housing portion 28 via any suitable means, such as an adhesive, and is fit within the upwardly recessed bottom surface 92 and held therein via the biasing force of the coil spring 108 that urges the coil spring 108 against the upwardly recessed bottom surface 82.

When the limiter 80 is moved toward a lower restricting position, as shown in FIG. 4A, the coil spring 108 is moved away from its neutral position N1 and compressed, and the biasing force of the coil spring 108 urges the limiter 80 away from the lower housing portion 28 in an effort to expand back toward the neutral position N1 of the coil spring 108.

A release member in the form of a paper strip 112 extends into and through the release member slot 104 and the box slot 100, and is positioned against an upper surface 116 of the release member slot 104. The paper strip 112 is sufficiently rigid that the biasing force of the coil spring 108 urging the limiter away from the bottom surface 36 of the lower housing portion 28 does not bend or rupture the paper strip 112 abutting against the upper surface 116 of the release member slot 104 to enable the limiter 80 to be moved away from the bottom surface 36 of the housing 24. It is said that, as the paper strip 112 is sufficiently rigid to restrict movement of the limiter 80 relative to the bottom surface 36 of the housing 24, it is in a lock state.

The limiter 80 has a generally cylindrical hollow 120 extending from an upper end thereof downwards. An alignment post 124 extends from a bottom surface 128 and centrally through the hollow 120. The alignment post 124 is generally parallel with the longitudinal axis LA, and extends out of the hollow 120.

Another biasing member in the form of a memory foam cylinder 132 is positioned in the hollow 120. Memory foam has cells that are open, creating a matrix through which air can slowly move, thus slowing its restoration to a neutral position N2. The memory foam cylinder 132 can be compressed and a biasing force thereof biases the memory foam cylinder 132 toward its neutral position N2; that is, an uncompressed state). In this embodiment, the biasing force of the memory foam cylinder 132 is lesser than the biasing force of the coil spring 112. This structure, when deformed either through compression or extension and then subsequently released, recovers its original form (i.e., neutral position N2) more slowly than the coil spring 108. The memory foam cylinder 132 has a through-hole 136 that slidingly receives the alignment post 124. The diameter of the memory foam cylinder 132 is smaller than the diameter of the hollow 120 to thereby allow lateral expansion of the memory foam cylinder 132 when positioned in the hollow 120.

An article in the form of a figurine 140 is positioned within the housing 24. The figurine 140 has an aperture 144 extending from a bottom surface thereof and upwards, terminating within the figurine 140. The aperture 144 is dimensioned to slidingly receive the alignment post 124, which retains the figurine 140 in an upright pose in the housing 24. In the housing 24, the figurine 140 may or may not be held in contact with an interior surface of the housing 24 via the biasing force of the coil spring 108 and/or the memory foam cylinder 132.

The package 20 is shown prior to release of the coil spring 108 and rupturing of the housing 24. The paper strip 112 is initially dry, meaning that it is not moistened or wetted beyond moderate ambient conditions. When the paper strip 112 is dry, it has a first tensile strength. It is said that the paper strip 112 is in a locked state when it is dry, as its tensile strength impedes longitudinal travel of the slotted box 96 and thus the limiter 80. Impediment of upward movement of the limiter 80 impedes movement of the coil spring 108 to its neutral position N1; that is, expansion along the longitudinal axis LA. The figurine 140 rests atop of the memory foam cylinder 132, and the positions of both atop of the alignment post 124 are maintained.

In order to trigger the release of the coil spring 108, the paper strip 112 is wetted, such as with water. The tensile strength of the paper strip 112 is decreased as the paper strip 112 is dampened. In order to condition the paper strip 112 to a release state, the paper strip 112 is sufficiently dampened, and its tensile strength deteriorates sufficiently to enable the biasing force of the coil spring 108 to push up on the limiter 80 with sufficient force so that the slotted box 96 ruptures the dampened paper strip 112. That is, in the release state, the paper strip 112 no longer possesses the tensile strength required to impede restoration of the coil spring 108 via its biasing force.

Figure 4B:
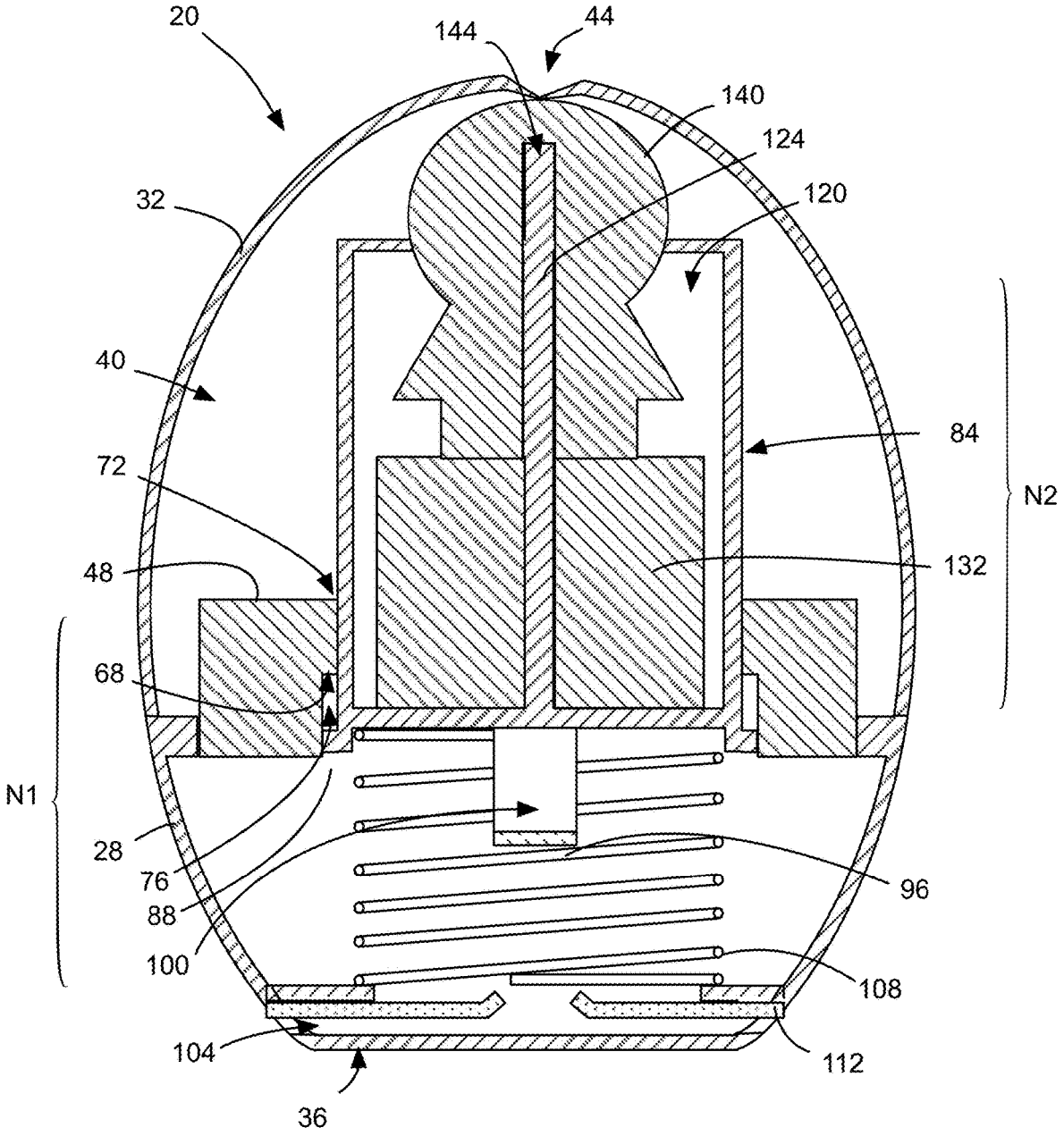
FIG. 4B is a schematic front elevation section view of the package of FIG. 1 during rupture of the release member and before breach of the housing by a figurine positioned in the housing.

FIG. 4B shows the package 20 after the paper strip 112 has been ruptured by the biasing force of the coil spring acting to move the limiter 80 and its slotted box 96 upward in a longitudinal direction. The biasing force of the coil spring 112 is exerted against the upwardly recessed bottom surface 92 of the limiter 80. The corresponding profiles of the outer longitudinally extending surface 84 of the limiter 80 and the inner guide surface 60 of the tubular guide 48 that extend longitudinally limit travel of the limiter 80 in a direction that is parallel to the longitudinal axis LA.

As the limiter 80 is urged upwards, the memory foam cylinder 132 and the figurine 140 resting thereon are driven upwards. Once the figurine 140 abuts the housing 24, the figurine 140 resists further travel upward. As a result, as the biasing force of the coil spring 108 is greater than the biasing force of the memory foam cylinder 132, and as the biasing force of the memory foam cylinder 132 is insufficient to drive the figurine 140 to rupture the housing 24, the memory foam cylinder 132 is thereafter compressed as the coil spring 108 expands. The enlarged space of the hollow 120 enables lateral expansion of the memory foam cylinder 132.

Once the alignment post 124 reaches the terminus of the aperture 144 within the figurine 140 (i.e., the state shown in FIG. 4B), continued expansion of the coil spring 108 drives the limiter 80 and its alignment post 124 upwards, causing the figurine 140 to push against the housing 24 adjacent one or more scores 44 making up the weakened region of the housing 24. The figurine 140 is sufficiently hard and has sufficient velocity from expansion of the coil spring 108 that it ruptures the housing 24. The limiter 80 and the figurine 140 thus act as a rupture structure that is driven by the coil spring 108 for rupturing the housing 24. Further, the tubular guide 48 and the limiter 80 act as a restoration alignment structure to limit driving of the rupture structure by the coil spring 108 along the longitudinal axis LA. While, in this embodiment, the rupture structure merely ruptures the housing 24, in other embodiments, the rupture structure can be driven to open the housing so that the figurine 140 can pass through freely.

Figure 4C:
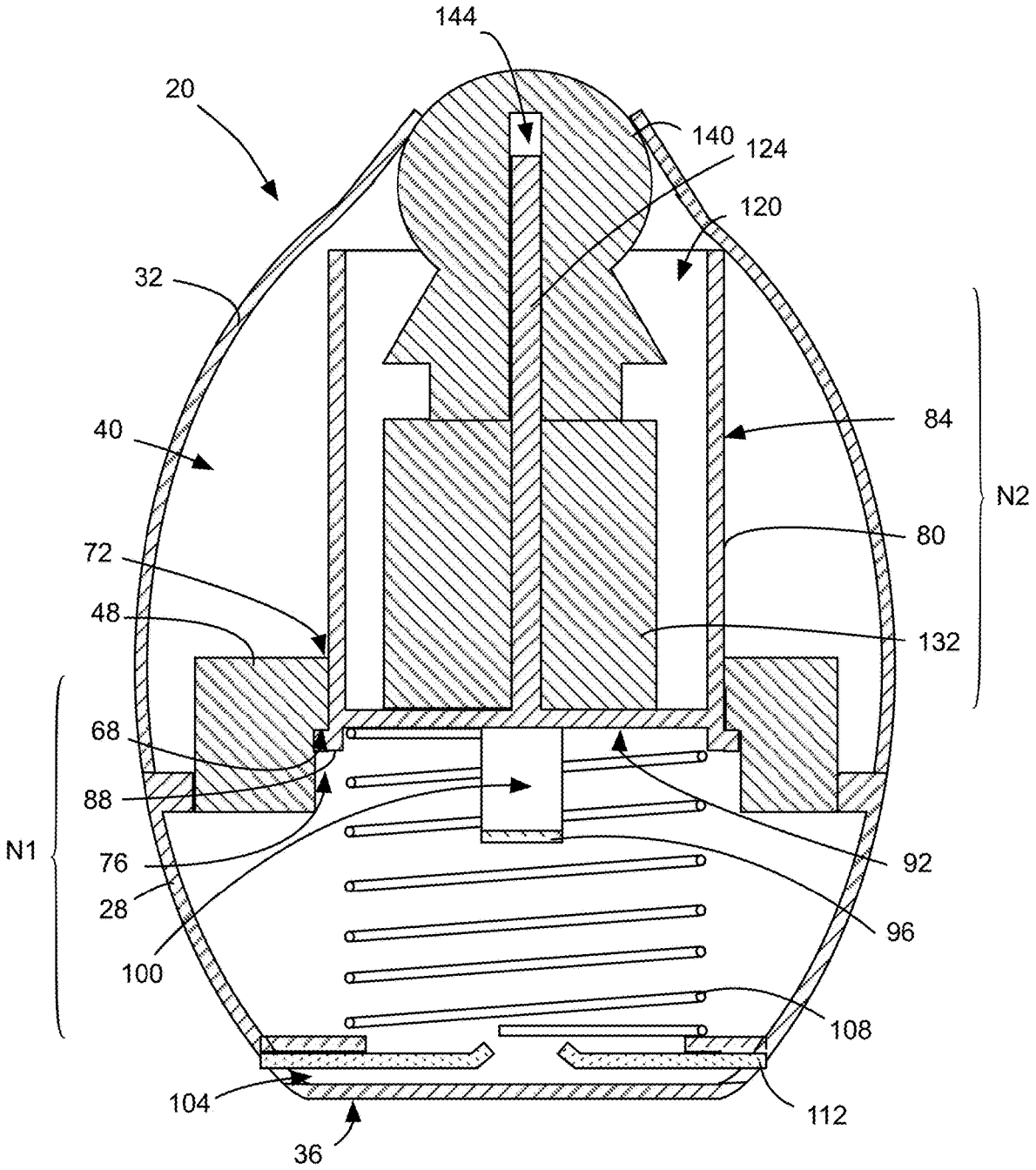
FIG. 4C is a schematic front elevation section view of the package of FIG. 1 during breach of the housing by a figurine positioned in the housing.

FIG. 4C shows the figurine 140 travelling upwards through the ruptured housing 24. Upon sufficient rupturing of the housing 24, the biasing force of the memory foam cylinder 132 overcomes the resistance to upward movement of the figurine 140 provided by the ruptured housing 24 and expands, thus moving toward its neutral position N2. Upward movement of the limiter 80 is impeded by abutment of the lower ridge 88 of the limiter 80 against the step 68 of the inner guide surface 60. Further movement of the coil spring 108 toward its neutral position is thus terminated. In this manner, the limiter 80 is restricted from emerging from the housing 24. The alignment post 124 extending through the through-hole 136 of the memory foam cylinder 132 maintains the memory foam cylinder 132 thereon, thereby primarily limiting restoration of the memory foam cylinder 132 along the longitudinal axis LA. Further, the positioning of the alignment post 124 in the aperture 144 of the figurine 140 limits movement of the figurine 140 along the longitudinal axis LA as the figurine 140 is being driven at least partially out of the housing 24 by the restoration of the memory foam cylinder 132.

Continued further movement of the memory foam cylinder 132 toward its neutral position N2 drives the figurine 140 at least partially out of the housing 24 when the housing 24 is ruptured. The speed of movement of the memory foam cylinder 132 toward its neutral position N2 is slower than the speed of movement of the coil spring 108 toward its neutral position N1 when unimpeded, as the spring rate of the memory foam cylinder 132 is lesser than the spring rate of the coil spring 108. As a result, the figurine 140 is moved upward slowly to give the figurine 140 the appearance of emerging from the housing 24 (in the shape of an egg), or growing.

Figure 4D:
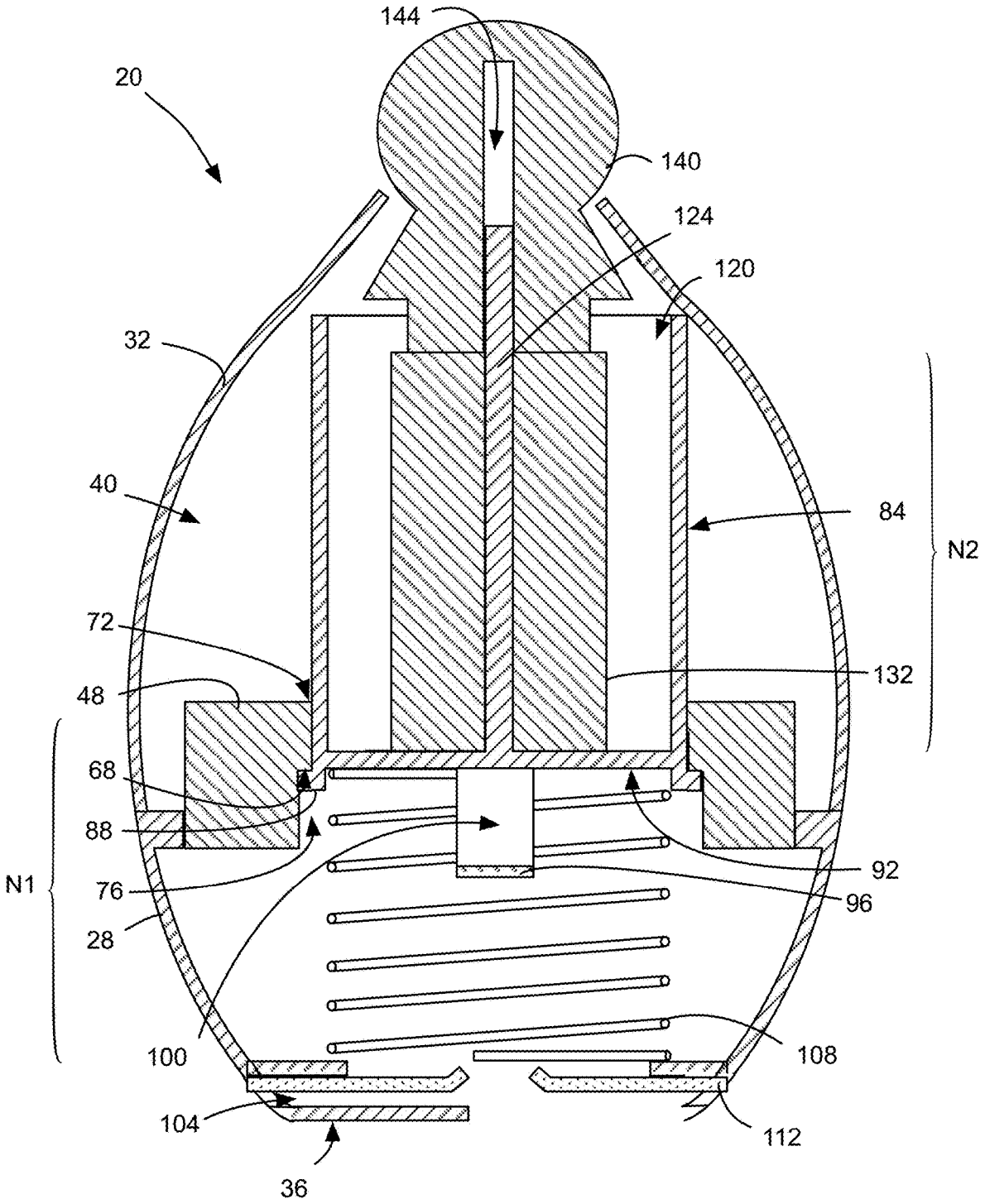
FIG. 4D is a schematic front elevation section view of the package of FIG. 1 after expansion of a memory foam member to drive the figurine at least partially out of the housing.

FIG. 4D shows the package 20 after the memory foam cylinder 132 has moved to its neutral position N2.

While, in the above-described and illustrated embodiment, the biasing members are compressed and exert a biasing force to move toward a neutral position (i.e., expand), in other embodiments, the biasing members can be extended beyond a neutral position and exert a biasing force to restore to the neutral position.

Figure 5:
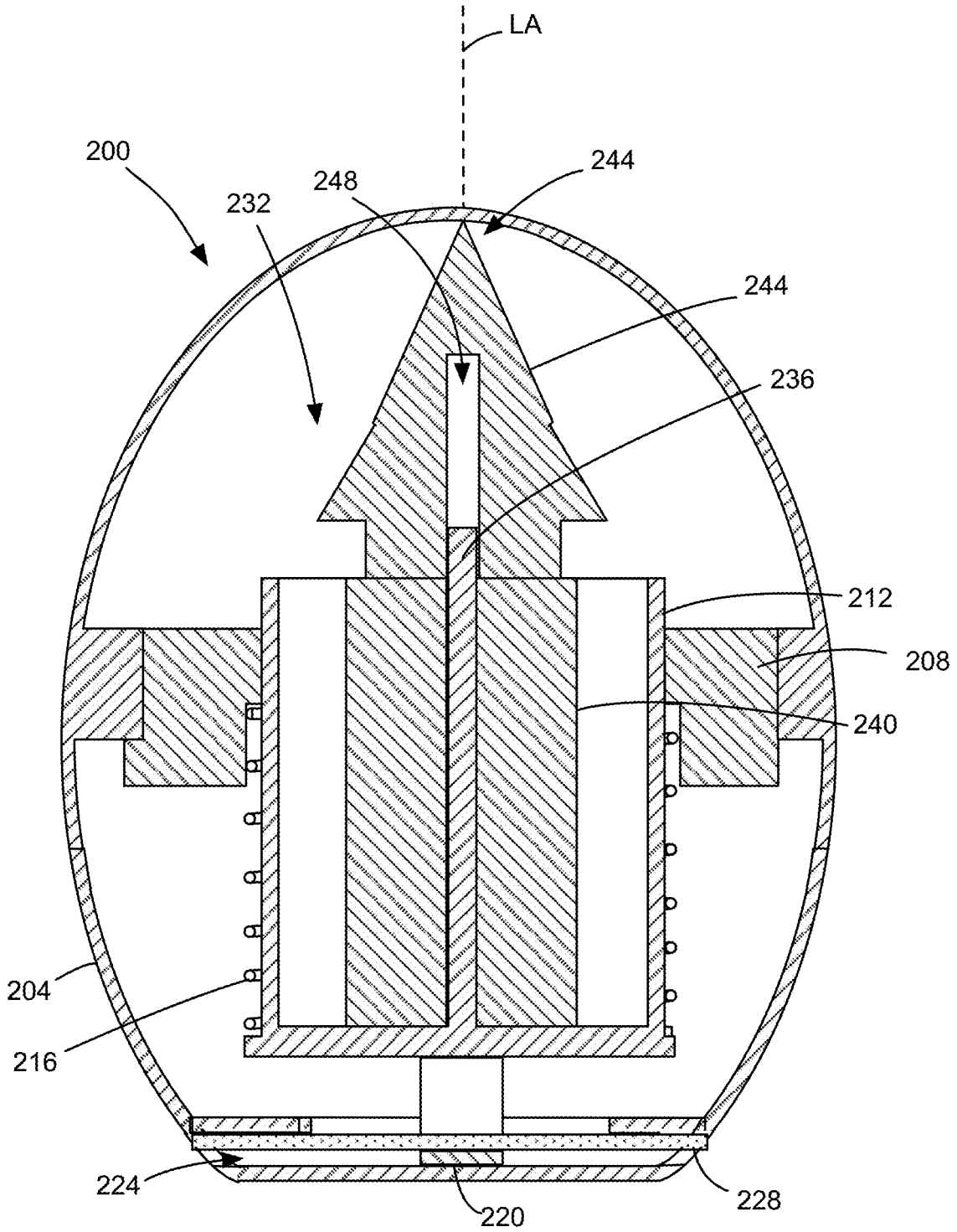
FIG. 5 is a schematic front elevation section view of an article ejection structure in accordance with another embodiment.

FIG. 5 shows an article ejection structure 200 in accordance with another embodiment. A housing 204 has a tubular guide 208 to an inside thereof. A tubular limiter 212 is slidingly received on an inside surface of the tubular guide 208. A coil spring 216 is coupled at a first end to the tubular guide 208 and at a second end to a bottom of the limiter 212. A slotted box 220 extends from the bottom of the limiter 212. The limiter 212 can be urged downwards, causing the coil spring 216 to expand beyond a neutral position until the slotted box 220 contacts an inside bottom surface of the housing 204. A release member slot 224 extends laterally through the bottom of the housing 204 and enables a paper strip 228 to be inserted through the slotted box 220 of the limiter 212. The paper strip 228 thus holds the slotted box 220 and thus the limiter 212 at a bottom position as shown. The limiter 212 has an opening 232 that extends from a top end thereof downwards. An alignment post 236 extends upward from a bottom surface of the opening 232. A memory foam cylinder 240 having a through-hole extending therethrough longitudinally is placed atop of the alignment post 236. An article 244 having an aperture 248 extending therein from a bottom thereof is positioned atop of the memory foam cylinder 240 and the alignment post 236 and the memory foam cylinder 240 is compressed to enable the assembly to be fitted within the housing 204.

When the bottom of the housing 204 is exposed to a liquid, such as water, the tensile strength of the paper strip 228 is reduced, enabling the restoring force of the expanded coil spring 216 to pull the limiter 212 and the slotted box 220 upwards through the weakened paper strip 228. The coil spring 216 continues to contract until it achieves a neutral position, thus driving the limiter 212 upwards. The memory foam cylinder 240 is compressed as upward travel of the article 244 is impeded by the housing 204, until the alignment post 236 engages a top end of the aperture 248 to push the article 244 to rupture the housing 204, much in the same manner as the package of FIGS. 1 to 4D. The housing 204 may be pre-weakened along a top portion thereof to facilitate rupturing via the article 244. The article 244 converges to a point 252 that focuses the restoring force of the coil spring 216 on a small inside surface area of the housing 204. Upon rupturing the housing 204, the memory foam cylinder 240 continues to return to a neutral position, pushing the article 244 outwards of the housing 204.

Other types of biasing members can be employed. For example, a deformable structure made of rubber or another suitably resilient material can be employed. The deformable structure can have a cavity into which ambient air is drawn via a small aperture, wherein the size of the aperture and the biasing force of the biasing member can determine the rate of restoration. Another example of a biasing member is an elastic member that is extended and has a biasing force moving the elastic band to a neutral position.

In other embodiments, the limiter can be constructed to abut against and rupture the housing before the figurine does and thus act as the rupture structure. For example, the limiter can extend further longitudinally to make contact with the housing first. Alternatively, the limiter can extend further laterally where the housing has a lower inner dimension, thus causing the limiter to abut earlier against the housing.

The housing can be provided with interior housing rupturing features that are engaged by the rupture structure to facilitate rupturing of the housing.

In the above described and illustrated embodiment, the first biasing member, the coil spring 108, is coupled to the second biasing member, the memory foam cylinder 132, to act on the second biasing member as the first biasing member expands. In particular, the second biasing member is compressed between the article, the figurine 140, and the housing 24 as the first biasing member moves toward a neutral position. In other embodiments, however, the first biasing member and the second biasing member can operate independent of one another.

Figure 6:
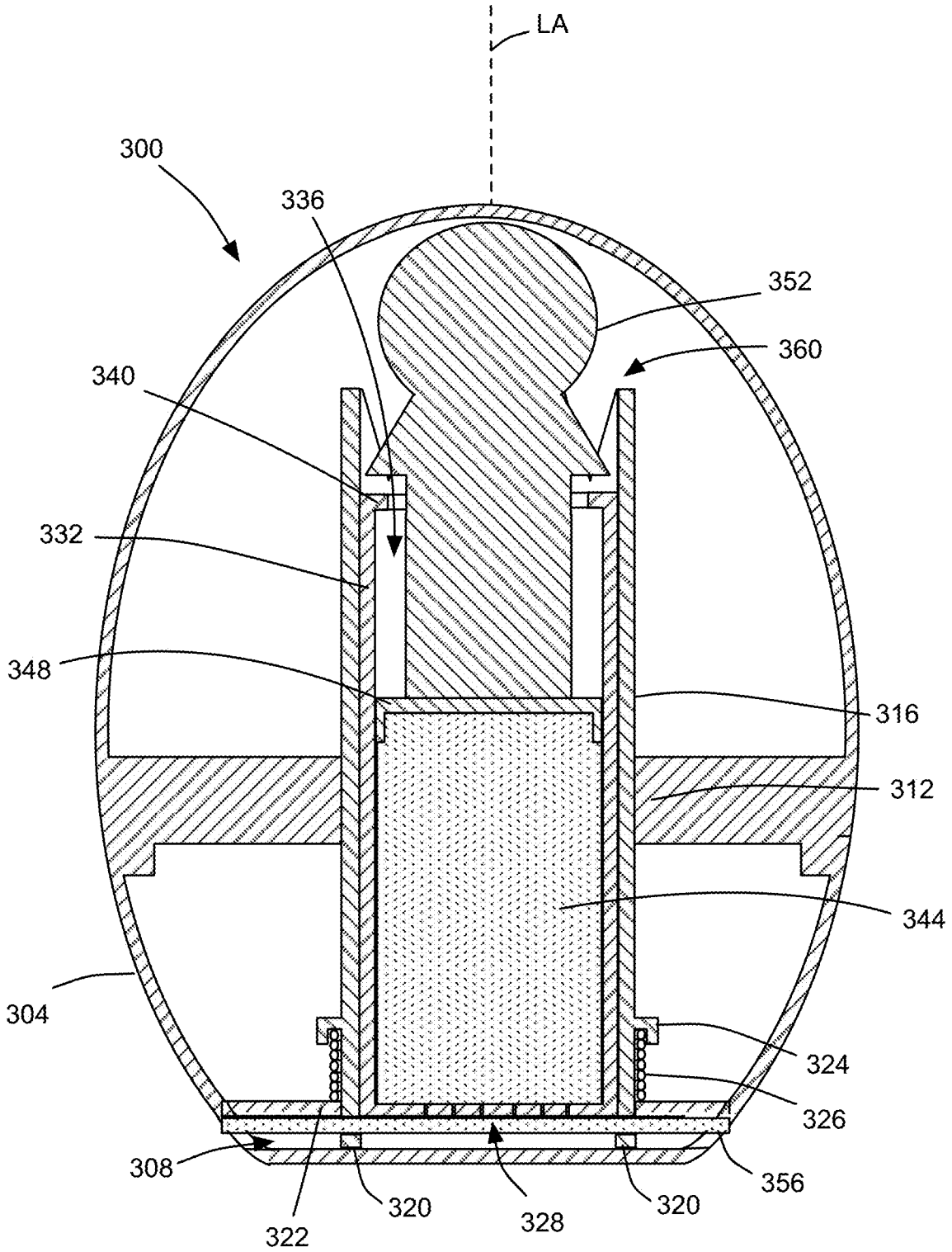
FIG. 6 is a schematic front elevation section view of an article ejection structure in accordance with a further embodiment.

FIG. 6 shows an article ejection structure 300 in accordance with a further embodiment. The article ejection structure 300 has a housing 304 having a release member slot 308 extending laterally through a bottom portion thereof. A tubular guide 312 is positioned within the interior of the housing 304. A tubular rupturer 316 is slidingly received within the tubular guide 312. Two slotted boxes 320 extend downwardly from a bottom surface of the tubular rupturer 316 and into the release member slot 308 through apertures in a bottom surface 322 of the housing 304. The tubular rupturer 316 has a downwardly facing annular trough 324 along its circumference towards a lower end thereof. A coil spring 326 that encircles the tubular rupturer 316 is positioned between the annular trough 324 and the housing 304 forming the upper surface of the release member slot 308. The upper surface of the release member slot 308 has a central perforated surface 328 that is liquid-permeable.

An inner tube 332 extends upwardly from the bottom surface 322 and into the tubular rupturer 316 and has a central aperture 336 that extends longitudinally downward from a top end thereof. An internal annular flange 340 extends inwardly along a top edge of the inner tube 332. A highly absorbent material, in this case a superabsorbent polymer 344, is positioned within the central aperture 336 at a lower end thereof. The perforation size of the perforated surface 328 is selected to inhibit the escape of the superabsorbent polymer 344 therethrough. A cap 348 is positioned atop of the superabsorbent polymer 344 within the central aperture 336 of the inner tube 332. Atop of the cap 348 is positioned an article in the form of a figurine 352. The cap 348 is sized to snugly fit against the inner walls of the central aperture 336 to prevent upward escape of the superabsorbent polymer 344 and contact of the figurine 352 with the superabsorbent polymer 344. A paper strip 356 is inserted into the release member slot 308 and through the slotted boxes 320 of the tubular rupturer 316 to inhibit upward travel of the tubular rupturer 316. In this position, the coil spring 326 is compressed and exerts a restoring force on the annular trough 324 of the tubular rupturer 316 and the bottom surface 322 of the housing 304.

When a bottom end of the housing 304 is exposed to a liquid, the tensile strength of the paper strip 356 is weakened, enabling the restoring force of the coil spring 326 to urge the tubular rupturer 316 upwards into contact with the top portion of the housing 304. The tubular rupturer 316 has a jagged top edge 360, focusing the force applied by the tubular rupturer 316 on smaller areas of the housing 304 to facilitate its rupturing. At the same time, the liquid is absorbed by the superabsorbent polymer 344 and expands, thus urging the cap 348 and the figurine 352 upwards at a slower rate than the upward motion of the tubular rupturer 316. Upward travel of the cap 348 is limited by the internal annular flange 340 of the inner tube 332. As a result, the housing 304 is broken, and the figurine 352 slowly emerges from it.

In another embodiment, the two biasing members can be concentric coil springs positioned at first ends thereof to push against the housing, each having a different spring rate. One of the coil springs (e.g., the outer coil spring) can be coupled to a rupture structure for rupturing the housing, such as a jagged ring, at a second end. The inner coil spring can be housed in a tube separating it from the outer coil spring and can exert a lesser biasing force moving it to a neutral position than the outer coil spring. Inside of the tube adjacent the second end of the inner coil spring can be positioned an article to be driven at least partially out of the housing once the housing is ruptured.

The restoration alignment structures can limit driving of a rupture structure and the article along axes that are not parallel. For example, once a rupture structure has been driven in a first direction to rupture the housing, the article can be driven in a second direction that is at a 40 degree angle relative to the first direction.

The release member and the release member slot can be made with any suitable dimensions so that the release member, when inserted into the release slot, inhibits expansion of the first biasing member.

While, in the above-described and illustrated embodiment, the limiter is slidingly moveable in the housing, the limiter can be designed in various other manners to control the biasing force exerted by the first biasing member on the rupture structure. For example, the limiter can be pivotally coupled to the housing.

While in the above-illustrated embodiment, the release member is a paper strip, the release member can be made at least partially from other natural fibers in some embodiments. For example, a release member made at least partially of wood fiber, when exposed to sufficient humidity or direct contact with a liquid, can soften sufficiently to enable bending or rupturing of the release member. The material of the release member can be a combination of natural fibers and other materials. In other embodiments, the release member can be made in other manners, so long as the release member can be conditioned between a lock state, in which the release member restricts movement of the biasing member toward its neutral position, and in a release state, the release member at least partially releases the first biasing member to move toward the neutral position.

Persons skilled in the art will appreciate that there are yet more alternative implementations and modifications possible, and that the above examples are only illustrations of one or more implementations. The scope, therefore, is only to be limited by the claims appended hereto and any amendments made thereto.

LIST OF REFERENCE NUMERALS

20 package
24 housing
28 lower housing portion
32 upper housing portion
36 bottom surface
40 inner space
44 score
48 tubular guide
52 peripheral threading
56 interior circumferential threading
60 inner guide surface
64 tubular channel
68 step
72 upper channel portion
76 lower channel portion
80 limiter
84 outer longitudinally extending surface
88 lower ridge
92 bottom surface
96 slotted box
100 box slot
104 release member slot
108 coil spring
112 paper strip
116 upper surface
120 hollow
124 alignment post
128 bottom surface
132 memory foam cylinder
136 through-hole
140 figurine
144 aperture
200 article ejection structure
204 housing
208 tubular guide
212 limiter
216 coil spring
220 slotted box
224 release member slot
228 paper strip
232 opening
236 alignment post
240 memory foam cylinder
244 article
248 aperture
252 point
300 article ejection structure
304 housing
308 release member slot
312 tubular guide
316 tubular rupturer
320 slotted box
322 bottom surface
324 annular trough
326 coil spring
328 perforated surface
332 inner tube
336 central aperture
340 internal annular flange
344 superabsorbent polymer
348 cap

352 figurine
356 paper strip
360 jagged top edge

The invention claimed is:

1. An article ejection structure, comprising:

a housing;

a first biasing member positioned in the housing, the first biasing member having a first biasing force biasing the first biasing member toward a first neutral position to drive a rupture structure to rupture the housing, the rupture structure comprising an article positioned in the housing;

a release member restricting the first biasing member from moving toward the first neutral position when the release member is in a lock state, the release member being conditionable to a release state, in which the release member at least partially releases the first biasing member to move toward the first neutral position and drive the ejection structure to rupture the housing; and a second biasing member positioned in the housing, the second biasing member having a second biasing force biasing the second biasing member toward a second neutral position to drive the article at least partially out of the housing when the housing is ruptured after driving of the rupture structure by the first biasing member has terminated.

2. An article ejection structure as claimed in claim 1, wherein the first biasing member is coupled to the second biasing member to move the second biasing member when the first biasing member moves toward the first neutral position.

3. An article ejection structure as claimed in claim 2, wherein the rupture structure includes the article.

4. An article ejection structure as claimed in claim 3, wherein the first biasing member has a first spring rate, and the second biasing member has a second spring rate, the second spring rate being lesser than the first spring rate.

5. An article ejection structure as claimed in claim 4, further comprising a restoration alignment structure limiting driving of the rupture structure by the first biasing member along an axis.

6. An article ejection structure as claimed in claim 5, wherein the restoration alignment structure includes a limiter slidingly moveable in the housing along the axis, the limiter being held in a restricting position relative to the housing via the release member when the release member is in the lock state, in which the limiter restricts movement of the first biasing member toward the first neutral position.

7. An article ejection structure as claimed in claim 6, wherein the limiter includes a slot through which the release member extends, the slot being accessible from an exterior of the housing, the housing including an abutment surface positioned adjacent the slot when the limiter is in the restricting position.

8. An article ejection structure as claimed in claim 7, wherein the release member is at least partially made of a natural fiber.

9. An article ejection structure as claimed in claim 8, wherein the natural fiber is a paper product.

10. An article ejection structure as claimed in claim 6, wherein the rupture structure includes the limiter.

11. An article ejection structure as claimed in claim 5, wherein the restoration alignment structure is a first restoration alignment structure, and wherein the axis is a first axis, further comprising a second restoration alignment structure limiting expansion of the second biasing member along a second axis.

12. An article ejection structure as claimed in claim 11, wherein the first axis is parallel to the second axis.

13. An article ejection structure as claimed in claim 12, wherein the second restoration alignment structure includes a post extending along the second axis from the limiter, and wherein the second biasing member has a through-hole that receives the post.

14. An article ejection structure as claimed in claim 13, wherein the article has an aperture for receiving the post.

15. An article ejection structure as claimed in claim 1, wherein the first biasing force is greater than the second biasing force.

16. An article ejection structure as claimed in claim 1, wherein the second biasing force is insufficient to drive the article to rupture the housing.

17. An article ejection structure as claimed in claim 1, further comprising a restoration alignment structure limiting driving of the article at least partially out of the housing by the second biasing member along an axis.

18. An article ejection structure as claimed in claim 1, wherein the housing is provided with a weakened region having a lower tensile strength and the article is positioned adjacent to the weakened region in the housing.

19. An article ejection structure as claimed in claim 18, wherein the weakened region includes at least one score line.

20. An article ejection structure as claimed in claim 1, wherein the first biasing member is a coil spring.

21. An article ejection structure, comprising:

a housing;

a biasing member positioned in the housing;

a rupture structure positioned within the housing; and a release member made at least partially of natural fiber and restricting restoration of the biasing member when the release member is in a lock state, the release member being conditionable to a release state via application of a fluid thereto, in which the release member at least partially releases the biasing member to move toward a neutral position and drive the rupture structure to rupture the housing.

22. An article ejection structure as claimed in claim 21, further comprising a limiter retained in a restricting position relative to the housing via the release member to restrict restoration of the first biasing member.

23. An article ejection structure as claimed in claim 21, wherein the limiter includes a slot through which the release member extends, the slot being accessible from an exterior of the housing, the housing including an abutment surface positioned adjacent the slot when the limiter is in the restricting position.

24. An article ejection structure as claimed in claim 21, wherein the release member is at least partially made of a paper product.

25. An article ejection structure as claimed in claim 21, wherein the fluid includes water.

* * * * *